United States Patent [19]

Axelrod

[11] 4,106,148

[45] Aug. 15, 1978

[54] METHOD OF BINDING PAPERS

[76] Inventor: Herbert R. Axelrod, 211 W. Sylvania Ave., Neptune, N.J. 07753

[21] Appl. No.: 745,872

[22] Filed: Nov. 29, 1976

[51] Int. Cl.[2] ..... B42C 19/00

[52] U.S. Cl. ..... 11/1 AD; 270/32

[58] Field of Search ..... 11/1 AD, 1 R; 270/32; 281/21 R

[56] References Cited

U.S. PATENT DOCUMENTS

| | | | |
|---|---|---|---|
| 2,914,318 | 11/1959 | McGarvey et al. | 270/32 |
| 3,179,967 | 4/1965 | Yohn et al. | 11/1 AD |

FOREIGN PATENT DOCUMENTS

| | | | |
|---|---|---|---|
| 2,325,937 | 12/1974 | Fed. Rep. of Germany | 11/1 AD |

*Primary Examiner*—Stephen C. Pellegrino

*Attorney, Agent, or Firm*—Fulwider, Patton, Rieber, Lee & Utecht

[57] ABSTRACT

A process is provided for binding a plurality of papers arranged together in signatures using an adhesive without requiring the spines of the signatures to be trimmed in order to allow adhesive applied from a single source to contact all of the papers to be bound. A linear array of apertures is cut into each of a plurality of papers. Each paper is folded back on itself to form a signature having two layers of paper with the apertures in each layer at least partially aligned. The signatures are positioned side by side and adhesive is applied concurrently to the spines of all of the signatures, thereby introducing adhesive into the apertures and bonding all of the layers of paper to each other. A backing is contacted with the spines of the signatures to form a cover, thereby providing a bound publication.

12 Claims, 9 Drawing Figures

METHOD OF BINDING PAPERS

FIELD OF THE INVENTION

The present invention relates to an improved method for binding paper publications.

BACKGROUND OF THE INVENTION

It is conventional practice in the art of publication binding to arrange the papers of publications to be bound in signatures. A signature is a printed sheet of rectangular paper folded into multiples of four pages which, when folded as a unit, forms a section of a book or pamphlet. A signature is formed by folding a rectangular sheet of paper along a first axis midway between parallel edges of the rectangle, and thereafter folding the composite structure along a second perpendicular axis midway between the other two edges of the rectangular piece of paper. The folded edges of the signature are trimmed along the first fold of the signature to form four leaves of paper with a page on either side of each leaf. In some instances different paper folds may be employed to provide signatures of 2,4,8,16, 24 or 64 leaves.

In conventional practice, hardcover books are "casebound" while paperback publications are "perfect" or "adhesive" bound. In case binding the leaves of the signatures may be sewn together along the spines of the signatures. The sewing operation is performed manually or by machine, using a needle and thread. After sewing each signature, a plurality of signatures are positioned adjacent to each other in mutually parallel alignment. This is called "gathering" or "collating." In gathering, the signatures are arranged so that pagination is in seratin order. After gathering, the signatures are sewn to each other and glued together. Thus, the leaves within each signature are held by thread while the signatures are both sewn and glued together. Thereafter, an adhesive is applied to the spines of the proximately located signatures. A backing material, called a "crash" is contacted with the adhesive to hold the spines of the signatures in a relatively close array. A starched cotton fabric or adhesive tape typically serves as a "crash" and is useful in reinforcing the spine of the publication. A casebound book usually requires the outer surfaces of the pages of special end paper signatures to be glued to the inside front and back covers of the book. Conventional case binding requires considerable hand labor, particularly in sewing together the signatures. It is a relatively lengthy, arduous and expensive process, but does result in a durable bound publication.

An alternative conventional method of publication binding is perfect or adhesive binding. This method of binding is typically used in conjunction with paperback books and other softcover publications. In perfect binding, signatures are formed in the manner previously indicated. However, rather than being sewn together, the spine edges are "padded." In padding, the folded spines are trimmed from the signatures after the signatures are gathered. Adhesive is then applied along the edges of the leaves from which the spines of the signatures were trimmed. In the process of glueing the signatures are flexed in a manner which enables a tiny bead of glue to be placed on each side of the spine side of the paper, thus enhancing adhesion between the pages. The fused edges of the leaves are then pressed against the center of the paperback cover and the adhesive is allowed to dry. Adhesive applied in this manner is free to seep in between the pages of the publication a short distance before drying, and hence provides an area of bonding on the pages in addition to the area at the rear edge of each page which is glued to the cover back.

Perfect or adhesive binding is much cheaper and easier than case binding, since no sewing operations are required. However, the quality of binding effected in this manner is inferior to case binding.

It is an object of the present invention to provide an improved method of publication binding which achieves the superior quality of case binding, but without the attendant disadvantage of labor intensive steps necessary in case binding. The high quality of case binding is posssible using the invention, since the leaves of the signatures are not separated from each other, but rather opposing leaves of a signature remain joined together along the signature spine.

It is a further object of the present invention to provide a method of binding utilizing an adhesive, such as glue, rather than utilizing a relatively expensive manner of fastening pages together, such as stitching with thread. The use of glue as a means of binding pages within a publication is possible by virtue of the apertures formed along the spines of the signatures bound together. By utilizing patterns of apertures, a means is provided by which the adhesive gains access to the interior pages of the signature, yet without completely separating opposing leaves from each other. Instead, the adhesive is introduced through the apertures cut into the paper and thereby provides additional bonding surface area on the pages of the publication to hold the publication leaves immobile relative to each other adjacent to the publication backing.

DESCRIPTION OF THE PREFERRED EMBODIMENT

Figure 1:
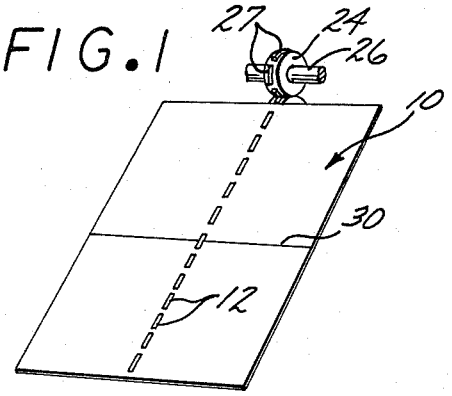
FIG. 1 is a diagramatic view showing the cutting of apertures in paper for use according to one embodiment of the invention.
Figure 2:
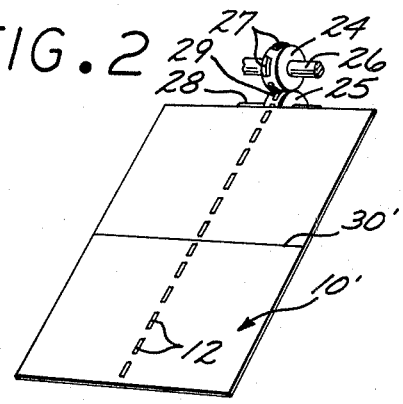
FIG. 2 shows the punching of a pattern of apertures linearly offset from the pattern of FIG. 1 for use in an alternative embodiment of the invention.
Figure 3:
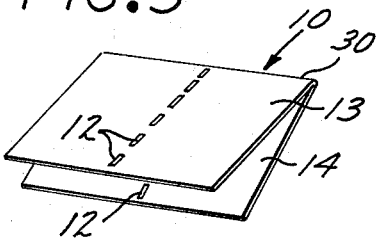
FIG. 3 illustrates the manner in which a sheet of paper is folded with the pattern of apertures produced in alignment on each layer of paper.

Referring now to the drawings, the steps of a method of binding a plurality of papers 10 and 10' each containing printed material to form a bound publication 11 are illustrated. Initially, linear patterns of apertures 12 are cut in straight lines across each paper 10 and 10' as depicted in FIGS. 1 and 2 to remove material therefrom. Each of the papers 10 is folded in half perpendicular to the straight line of apertures 12 along a real or imaginary line 30 as depicted in FIG. 3 to form layers 13 and 14 of pages on either side of the pattern of apertures 12. The apertures 12 in each of the layers 13 and 14 are mutually aligned in a straight line in an overlapping manner. The papers 10 are then folded again along the patterns of apertures 12 in the manner depicted in FIG. 4 to form folded edges 15 cut with apertures 12. Papers 10' may be folded separately in a similar manner. Each paper 10 comprises a signature 16, while each paper 10' so folded likewise comprises a signature.

Figure 5:
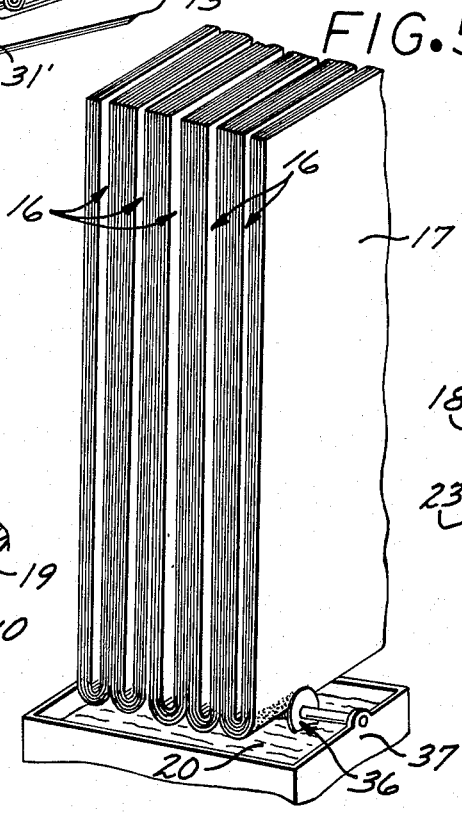
FIG. 5 illustrates the application of adhesive to a plurality of gathered signatures aligned adjacent to each other.

A plurality of the signatures 16 are gathered or positioned adjacent to each other in symmetrical orientation as indicated in FIG. 5, thereby exposing only the external surfaces 17 and 18, which are the front and back pages of the outermost layers of the papers 10 of all the surfaces of the various pages 19.

An adhesive 20 is externally applied to the folded parts or signatures 16 at the outermost layer 14 of each paper 10 along the folded edge 15 cut with apertures 12. This allows adhesive 20 to seep through the apertures 12 to contact both sides of all the pages 19 in the spine area. Thereafter, a backing 21 is contacted with the adhesive to bind the backing 21 to the papers 10. The external surfaces 17 and 18 of the front and back pages of the publication 11 may be covered with an adhesive and contacted with the front and back covers 22 and 23 respectively of the backing 21. When this form of construction is used, a heavier grade paper is usually employed to form the front and back pages having exterior surfaces 17 and 18, as compared with the remaining pages 19 of the publication 11.

FIG. 1 illustrates the aperture cutting operation in one manner of practice of the invention while FIG. 2 illustrates an additional manner of cutting which may be used in conjunction with the operation of FIG. 1 to practice the invention in an alternative form. As depicted in both FIGS. 1 and 2, a pair of die-punch members 24 and 25 are employed to cut a line of rectangular holes 12 in the sheets of paper 10. The apertures 12 are of rectangular configuration and have a length dimension at least 5 times the width dimension. The die-punch member 24 is a disk positioned for rotation about an axis 26 perpendicular to the linear alignment of the apertures 12 in the linear aperture pattern. The member 24 is positioned on one side of a sheet of paper 10 and has radially mounted male die protuberances 27 extending therefrom. The other die member 25 includes a mating disk positioned for rotation about an axis 28 likewise perpendicular to the linear alignment of the apertures 12 in the linear pattern depicted, but on the opposite side of the paper 10. The member 25 has female die receptacles 29 defined therein extending radially inward toward the axis 28. Cutting of the apertures 12 is effected by passing the papers 10 between the die members 24 and 25 as they rotate about their respective axes 26 and 28.

The cutting of apertures in sheets of paper 10' is depicted in FIG. 2 and is carried out in a manner identical to that in which apertures 12 are cut in papers 10 with one significant distinction. It should be noted that the apertures 12 are linearly offset from each other in the two different sheets of paper 10 and 10' depicted respectively in FIG. 1 and in FIG. 2. That is, it should be noted that the line 30 bisecting the sheet of paper 10 in FIG. 1 passes directly through one of the apertures 12. To the contrary, the line 30' bisecting the sheet of paper 10 in FIG. 2 passes between longitudinally adjacent ones of the apertures 12. As a result of this difference in cutting apertures, a particular manner of construction of a signature group 16' of FIG. 8 may be effected.

Figure 4:
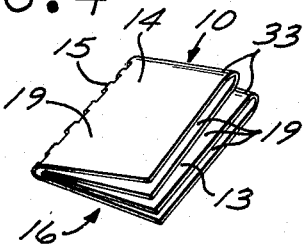
FIG. 4 illustrates a sheet of paper folded from the position of FIG. 3.

It should be understood that papers arranged either in single signatures 16 or in signature groups 16' may be employed according to the present invention. The alternative forms of the practice of the invention associated with each will be explained. To form a single signature 16, each paper 10 is folded back on itself following the cutting of apertures therein to form an inner layer 13 and an outer layer 14 as depicted in FIG. 3. The apertures 12 in each of the layers 13 and 14 are aligned to overlap each other so that the composite aperture through the double thickness may either be substantially of the same dimensions as the aperture dimensions through a single thickness of the paper 10, or somewhat smaller, depending upon the degree of overlap desired. In either event, one manner of practice of the invention requires merely folding the sheets 10 across the lines of apertures 12 to form a plurality of signatures 16 each having four separate thicknesses, or pages 19 as depicted in FIG. 4. These signatures 16 can then be gathered and glued as depicted in FIGS. 5 and 9 and as heretofore described.

Figure 6:
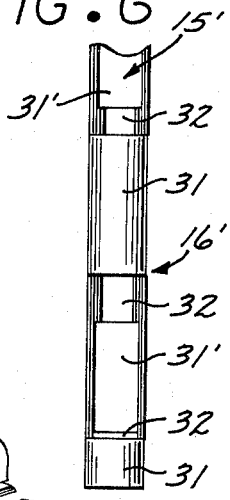
FIG. 6 is an enlarged view of a section of the spine of a folded signature according to an alternative embodiment of the invention.
Figure 9:
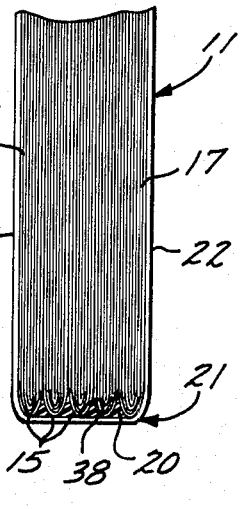
FIG. 9 is an end view of a publication bound according to the present invention.

Alternatively, groups 16' of signatures formed from sheets of paper 10 and 10' might be utilized in FIGS. 5 and 9 in place of the separate signatures 16. In practicing the invention in this manner, two sheets of paper 10 and 10' may be positioned together in the manner depicted in FIGS. 6, 7 and 8 to form groups 16' of signatures. Each group 16' has eight thicknessess or pages 19, instead of four as in signatures 16. Using the alternative practice of the invention, a page 10' may be nested into a page 10 in the manner depicted in FIGS. 7 and 8. In this arrangement, the material remaining in the paper 10' along the pattern line of apertures 12 passes through the apertures 12 of the paper 10 as loops 31'. The spine 15' of a signature group 16' is thereby constructed of alternating loops 31' of the paper 10' and loops 31 of the paper 10 as depicted in FIG. 6.

Figure 8:
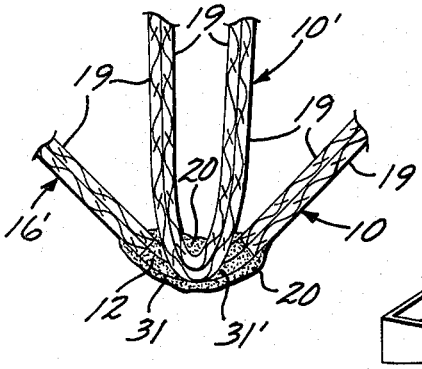
FIG. 8 is a sectional view taken along the lines 8—8 of FIG. 7.

It must be kept in mind that for such a system to be workable, the aggregate length of apertures 12 in each paper 10 and 10' must be greater than 50% of the length of the paper along the direction of alignment perpendicular to the fold lines 30 and 30'. Even though the composite apertures 32 remaining after the paper 10' has been inserted and placed as indicated in FIG. 6 are much smaller than the apertures 12 of each sheet of paper, they are still of some significant dimension. This is important since in the application of adhesive, usually a conventional glue, there must be some opening through which the glue 20 can seep to contact all of the pages 19 of the signature 16'. The permeation of glue within the structure of the signature group 16' is depicted in FIG. 8.

The alternative practice of the invention using only the signatures 16 is somewhat similar to the use of signature groups 16'. This form of construction does not require sheets 10' with apertures 12 offset from sheets 10. Rather, each of a plurality of papers 10 is folded back on itself following the cutting of apertures 12 therein in the manner of FIG. 3. By thereafter folding the paper 10 in the manner of FIG. 4, a signature 16 is formed having two layers, 13 and 14, together defining four separate pages, or thicknesses. The folded edges 33 of the signatures 16 must be trimmed from the signatures to form pages, but this would not ordinarily be done prior to binding the plurality of signatures 16 together.

The manner of binding signatures 16 or groups 16' of signatures together is the same, and is depicted, for example, with respect to signatures 16 in FIG. 5. A plurality of papers 10 formed of signatures 16 folded in layers 13 and 14 as previously indicated are positioned in side by side relationship as illustrated in FIG. 5. With the signatures 16 in juxtaposition and in symmetrical alignment as in FIG. 5, they may be passed together over a rotatable glue wheel or drum 36. The glue wheel 36 carries glue 20 from a glue tray 37 to externally apply glue 20 to the folded papers 10 or 10 and 10'. The glue 20 seeps through the apertures 12, or the resultant apertures 32 of reduced dimensions, to contact all of the pages 19. While the glue 20 is still wet, it is contacted with a backing 21 which, when the adhesive 20 dries, becomes bonded to the papers 10 or 10 and 10'. The signatures then become bound along their spines 15 or 15' to each other and to the interior surface of the spine 38 of the backing 21, thus forming a bound publication 11. The bound publication 11 has a cover formed of the backing material 21 that encompasses all of the signatures 16 or signature groups 16'. Either prior to application of the adhesive, or subsequent thereto, the folded edges 33 of the signatures 16 or 16' must be trimmed.

The relative length of the apertures 12 to the length of paper at loops 31 or 31' may vary. Preferably, the actual aggregate length of the openings 12 is from 30 to 70 percent of the length of the paper 10 along the path of aperture alignment. The desirable variations within this preferred range vary in accordance with paper strength, degree of glue absorption by the paper, and viscosity of the glue.

Publication binding according to the present invention is noteworthy in several respects in addition to those previously explained. Specifically, in conventional perfect binding practice the spines of the signatures 16 are removed with a high speed cutting wheel. The concurrent removal of the spines from a plurality of signatures produces a high piercing scream and results in a great deal of dust. This dust represents both an explosion hazard and a fire danger. By obviating the need for concurrently removing the spines of a plurality of signatures as in conventional paperback binding operations, these dangers and disadvantages are avoided.

Figure 7:
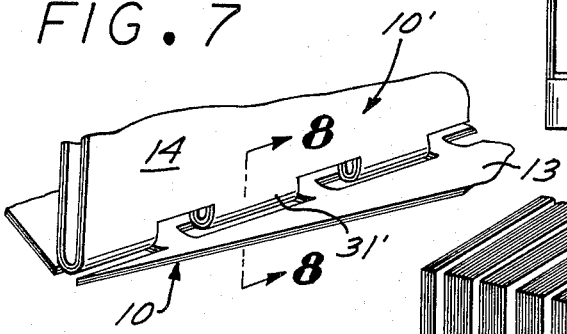
FIG. 7 is a perspective view showing the manner of folding the signature of FIG. 6.

A further feature of the invention is that signatures constructed according to FIGS. 7 and 8 may be stored and the decision as to their manner of attachment together deferred until a later time. That is, the signature 16' could be stored and later attached together by gluing as in FIG. 5, or they could be sewn together at a later time if the publication proved too voluminous to rely solely upon gluing as a mechanism for binding.

The foregoing description of several modes of practice of the method of the invention described herein should not be considered limiting, as various modifications will undoubtedly become readily apparent to those familiar with binding publications. For example, it will be readily apparent that the number of pages in a signature need not be limited to the eight different pages or thicknesses 19 in FIG. 8, but rather can be expanded by any multiple of four by properly dimensioning and orienting the apertures 12 of sheets of paper within a signature group.

I claim:

1. A method of binding a plurality of papers arranged in sheaves within a backing comprising cutting a straight line of apertures in a plurality of papers to remove material therefrom in linear patterns across each paper;

position said papers in juxtaposition with patterns of apertures of said papers mutually aligned in a straight line and at least partially linearly offset from each other;

folding said papers along said straight line of apertures to expose layers of material of each of said papers between said apertures for access by an adhesive applicator from one side of said plurality of papers;

applying an adhesive substance to said exposed layers of material in a single step; and contacting a backing with said adhesive to bond said backing to said exposed layers of material of each of said papers.

2. The method of claim 1 further characterized in that said step of cutting said straight line of apertures is performed with die-punch members to remove material from said papers, thereby leaving said apertures.

3. The method of claim 2 further characterized in that said apertures are of rectangular configuration having a length dimension at least five times the width dimension.

4. The method of claim 2 further characterized in that one of said die punch members is a disk positioned for rotation about an axis perpendicular to the linear alignment of said apertures in said pattern and having radially mounted male die protuberances extending therefrom and another die member is a mating disk positioned for rotation about an axis perpendicular to the linear alignment of said apertures in said pattern and having radially extending female die receptacles defined therein, whereby cutting is effected by passing said papers between said die members as they rotate to coact.

5. The method of claim 1 further comprising folding each paper back on its following the cutting of apertures therein to form a signature from each paper having two layers with the apertures in each layer aligned in a straight line in a linearly offset fashion, and whereby said folding of said plurality of papers together aligns said apertures of each signature in a linearly offset fashion.

6. The method of claim 5 further comprising folding each signature along the straight line formed by the aforesaid alignment of the apertures in each layer, positioning a plurality of folded signatures in side by side relationship and concurrently applying said adhesive substance to exposed edges of all of said signatures at said apertures.

7. A method of binding a plurality of signatures to form a bound publication comprising:

cutting a linear array of apertures in each of a plurality of papers, thereby removing material therefrom;

folding each of said papers perpendicular to said linear array of apertures into a signature of two layers with the apertures of each layer linearly aligned and at least partially linearly offset from each other to expose laminar surfaces of material between said apertures of each of said layers to concurrent access from one side of one of said layers, gathering said signatures into side by side relationship;

concurrently coating an adhesive to said exposed laminar surfaces of said layers of each signature along the line of alignment of apertures therein, thereby introducing adhesive into said apertures to contact laminar surfaces of all of said layers, and contacting a backing material with said coated papers, before said adhesive cures to bond said backing to all of said layers of said papers.

8. The method of claim 7 further comprising passing said signatures across a rotating medium carrying a quantity of adhesive.

9. The method of claim 8 further characterized in that said medium is a roller carrying adhesive on its radial surface.

10. The method of claim 7 further characterized in that the aggregate length of said apertures in each paper is greater than 50% of the length of said paper along the direction of alignment and further comprising cutting said linear array of apertures in different ones of said papers in longitudinally offset relationship, and nesting ones of said papers folded separately into signatures in which apertures are offset relative to others of said papers folded separately into signatures one within another to form separate signature groups each formed of a plurality of signatures subsequent to folding, whereby material from said ones of said signatures along the paths of alignment of apertures therein passes through the apertures of said others of said signatures.

11. A method of binding a plurality of papers each containing printed material to form a bound publication comprising:

cutting a linear pattern of apertures in a straight line across each paper to remove material therefrom;

folding each of said papers in half perpendicular to said straight line to form a structure having layers of pages on either side of said pattern of apertures with apertures in each of said layers mutually aligned in a straight line in an overlapping manner to expose laminar surfaces of material between said apertures of each of said layers to concurrent access from one side of each structure, and folding said papers again along said patterns of apertures to form folds cut with at least partially linearly offset apertures;

positioning a plurality of said folded papers adjacent to each other in symmetrical orientation thereby exposing only the front and back pages on ones of the outermost layers of said papers of all the surfaces of said pages;

concurrently externally applying an adhesive substance to said folds at the outermost layer of each of said papers along the folds cut with apertures, thereby allowing adhesive to seep through said apertures to contact the exposed laminar surfaces of material between apertures of of said pages; and contacting a backing with said adhesive before said adhesive dries to bond said backing to said papers and to secure said papers to each other.

12. The method of claim 11 further comprising applying adhesive to said front and back pages and contacting said backing therewith.

* * * * *